US006171155B1

(12) United States Patent
Miwa et al.

(10) Patent No.: US 6,171,155 B1
(45) Date of Patent: Jan. 9, 2001

(54) FEMALE ELECTRICAL TERMINAL WITH A LOW INSERTION FORCE RESILIENT CONTACT MEMBER

(75) Inventors: Takeya Miwa; Shigeru Tanaka, both of Shizuoka (JP)

(73) Assignee: Yazaki Corporation, Tokyo (JP)

( * ) Notice: Under 35 U.S.C. 154(b), the term of this patent shall be extended for 0 days.

(21) Appl. No.: 09/290,423

(22) Filed: Apr. 13, 1999

(30) Foreign Application Priority Data

Apr. 15, 1998 (JP) ..... 10-104571

(51) Int. Cl.[7] ..... H01R 11/22; H01R 13/11

(52) U.S. Cl. ..... 439/852; 439/845

(58) Field of Search ..... 439/850, 851, 439/852, 853, 854, 855, 856, 862, 844, 845

(56) References Cited

U.S. PATENT DOCUMENTS 4,540,233 * 9/1985 Saijo et al. ..... 439/834
4,717,356 * 1/1988 Rahrig et al. ..... 439/464
4,880,401 * 11/1989 Shima et al. ..... 439/746
5,226,842 * 7/1993 Endo et al. ..... 439/843
5,271,741 * 12/1993 Saito et al. ..... 439/843
5,443,592 * 8/1995 Ittah et al. ..... 439/851

* cited by examiner

*Primary Examiner*—Neil Abrams
*Assistant Examiner*—Michael C. Zarroli
(74) *Attorney, Agent, or Firm*—Armstrong, Westerman, Hattori, McLeland & Naughton

(57) ABSTRACT

A female electrical terminal of the present invention has a box-like electrical contact section; a resilient contact member contained in the electrical contact section for electrical connection with a male terminal; and a low force insertion enabling means provided on the resilient contact member, which enables a reduction in the force with which to insert the male terminal into the electrical contact section and into electrical connection with the resilient contact member. The low force insertion enabling means is a cutout or a thin wall portion formed between a central portion of the resilient contact member and at least one of its front and rear ends.

3 Claims, 5 Drawing Sheets

FEMALE ELECTRICAL TERMINAL WITH A LOW INSERTION FORCE RESILIENT CONTACT MEMBER

BACKGROUND OF THE INVENTION

1. Field of the Invention

This invention relates to a female electrical terminal which requires a low insertion force for a mating male terminal to be fitted therein.

2. Description of the Related Art

A conventional female electrical terminal 80, as shown in FIGS. 6 and 7, has a box-shaped electrical contact section 82 for insertion therein of a male terminal 81 and a cable connection section 83 at which a cable (not shown) is solderlessly attached, the electrical contact section 82 being internally provided with a resilient contact member 84 for electrical connection with the male terminal 81.

The resilient contact member 84 is, at its front and rear ends 84*a* and 84*b* (FIG. 7), lockedly engaged on a bottom wall 85 of the electrical contact section 82 to provide between the front and rear ends 84*a*, 84*b* a raised central contact portion 84*c* for the male terminal 81. When inserted into the electrical contact section 82, the male terminal 81 is squeezed between a ceiling wall of the electrical contact section 82 and the resilient contact member 84 to be electrically connected with the electrical contact section 82.

In order to enable the male terminal 81 to be inserted into the female terminal 80 with a low insertion force, if the deflection A (FIG. 7) within which the resilient contact member 84 is deflectable is made small, it requires accurate dimensions inside the electrical contact section 82, resulting in difficult designing. If the wall thickness B of the entire resilient contact member 84 is thinned (FIGS. 7 and 8), it also requires accurate dimensions for preventing lowering of the contact pressure between the male terminal 81 and the contact portion 84*c*, resulting in difficult designing. Likewise, if the wall width C of the resilient contact member 84 and thus of the contact portion 84*c* is made small (FIG. 9), it causes an unstable contact between the male terminal 81 and the contact portion 84*c*. Further, if the structure of the resilient contact member 84 itself is changed, it requires a renewed designing from the beginning, resulting in a cost increase. Generally, the more the reduction is made in the force required for inserting the male terminal 81, the more the contact between the male terminal 81 and the resilient contact member 84 becomes unstable, and the more the contact is made stable, the less the reduction can be made in the insertion force of the male terminal 81.

SUMMARY OF THE INVENTION

This invention has been accomplished to overcome the above drawbacks and an object of this invention is to provide a female electrical terminal which is easily changeable in design and which provides a stable contact with a male terminal.

In order to attain the object, according to this invention, there is provided a female electrical terminal which comprises: a box-like electrical contact section; a resilient contact member contained in the electrical contact section for electrical connection with a male electrical terminal; and a low force insertion enabling means provided on the resilient contact member, which enables a reduction in an insertion force with which to insert the male electrical terminal into the electrical contact section and into electrical connection with the resilient contact member.

Preferably, the resilient contact member is at its front and rear ends locked in position on an inner wall of the electrical contact section such that its longitudinally central contact portion is located elevated from the inner wall.

Preferably, the low force insertion enabling means comprises a cutout formed between the central contact portion and at least one of the front and rear ends of the resilient contact member.

Preferably, the low force insertion enabling means comprises a pair of cutouts formed at laterally opposite sides of the resilient contact member between the central contact portion and at least one of the front and rear ends of the resilient contact member.

Preferably, the pair of cutouts are of rectangular shape.

Preferably, the pair of cutouts are of curved shape.

Preferably, the low force insertion enabling means comprises a thin wall portion at which the resilient contact member is reduced in thickness, the thin wall portion being located between the central contact portion and at least one of the front and rear ends of the resilient contact member.

The above and other objects, features and advantages of this invention will become apparent from the following description and the appended claims, taken in conjunction with the accompanying drawings.

DESCRIPTION OF THE PREFERRED EMBODIMENTS

Embodiments of this invention will now be described with reference to the attached drawings.

Figure 1:
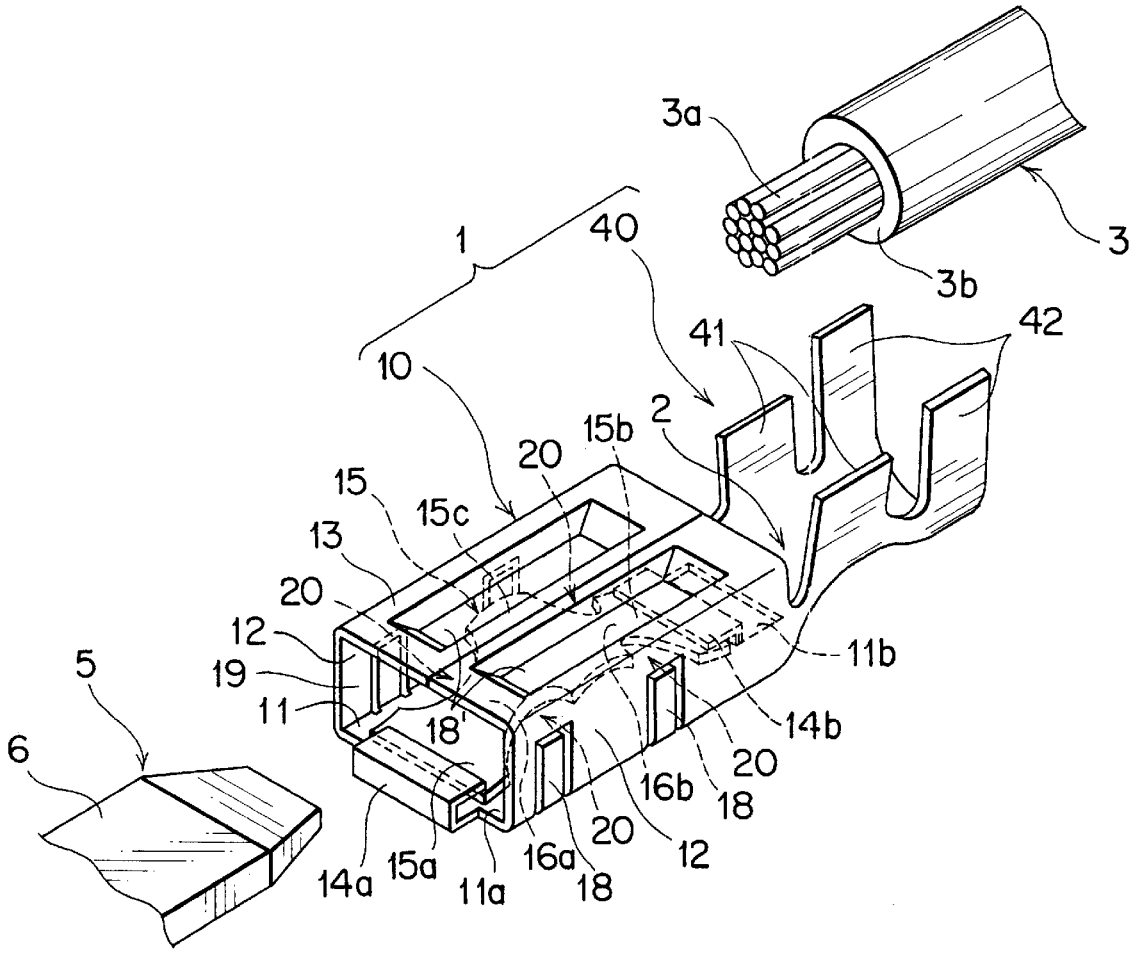
FIG. 1 is a perspective view of a female terminal according to a first embodiment of this invention, with a male terminal and a cable partly shown.
Figure 2:
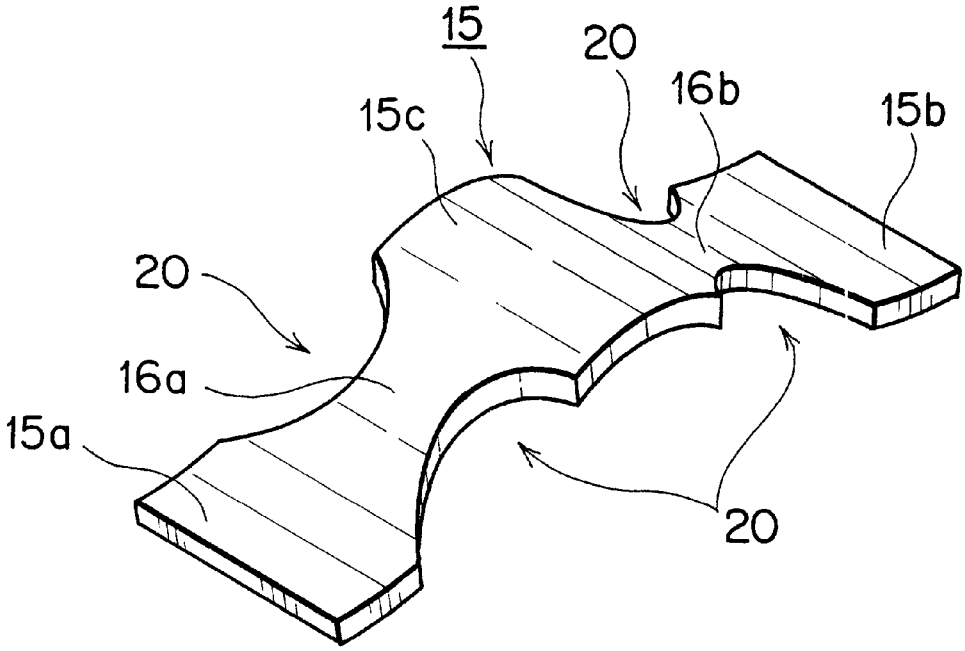
FIG. 2 is an enlarged perspective view of a resilient contact member as in FIG. 1.
Figure 3:
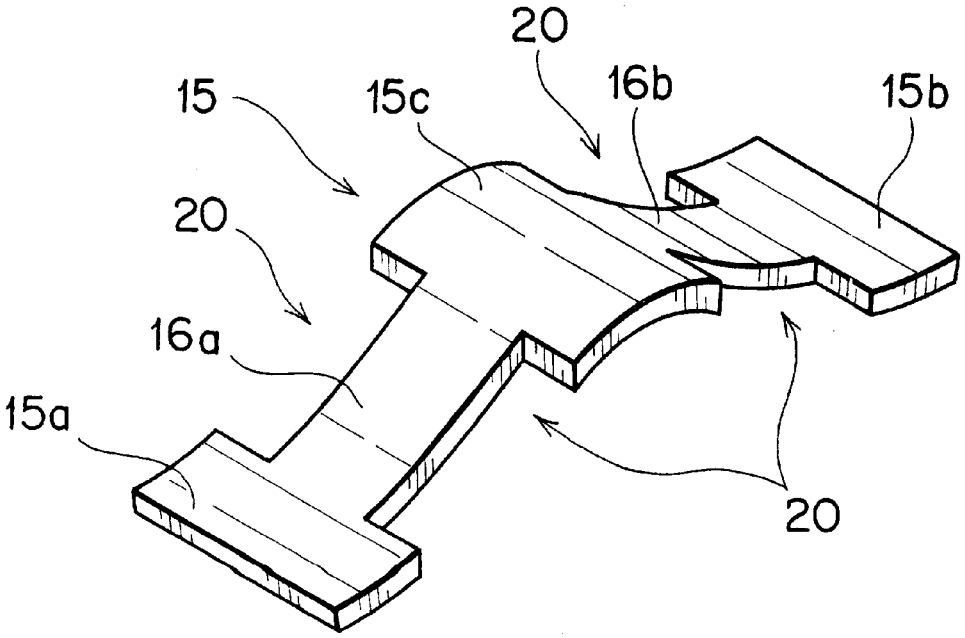
FIG. 3 is a view similar to FIG. 2, showing a variant of the resilient contact member.

FIGS. 1 to 3 show a female terminal according to a first embodiment of this invention.

In FIG. 1, a female terminal 1 is formed of a base plate 2 and includes a box-like electrical contact section 10 formed at a front half of the base plate 2 and a cable connection section 40 at which a cable 3 is solderlessly attached, which is formed at a rear half of the base plate 2.

The electrical contact section 10 has a bottom wall 11, side walls 12, 12 upstanding at opposite sides of the bottom wall 11, a ceiling wall 13 bridging the side walls 12, 12 at upper ends thereof, and a resilient contact member 15 received inside the electrical contact section 10.

The resilient contact member 15 is at its front and rear ends 15*a* and 15*b* engaged in respective front and rear locking elements 14*a* and 14*b* to be locked on the bottom wall front and rear halves 16*a*, 16*b* of the contact member 15 can be reduced. Owing to this, the insertion of the tab-like contact portion 6 into the electrical contact section 10 and into contact with the contact member 15 can be made with a smaller force than before. On the other hand, because the contact portion 15*c* and the front and rear ends 15*a*, 15*b* remain as they are (no cutouts are made), the contact between the tab-like contact portion 6 and the contact portion 15*c* is stabilized and maintained so after their connection. Further, because all that must be done is to provide cutouts 20 in the resilient contact member 15, the female terminal 1 can be easily produced with a minor change in design, not causing an increase in cost.

Further, in the case of the cutouts 20 of curved shape, because the resilient contact member 15 becomes gradually narrower and then wider from its front end 15*a* toward its central contact portion 15*c*, and from its contact portion 15*c* toward its rear end 15*b*, the resilient force changes smoothly in the longitudinal direction of the contact member 15 as compared with the cutouts 20 of rectangular shape, resulting in the male terminal 5 more stably held on the contact portion 15*c* of the contact member 15.

The electrical contact section 10 has stopper walls 18 at its opposite side walls 12, 12, which serve to prevent lateral sliding of the electrical contact section 10 after it is inserted into a terminal receiving cavity (not shown) 11 such that its longitudinally central portion is located at a position elevated from the bottom wall 11 to provide a contact portion 15*c* for a mating male terminal 5. The resilient contact member 15 has a later-described low force insertion enabling means at its front half 16*a* and rear half 16*b*. When inserted through a terminal insertion opening 19 at the front end of the electrical contact section 10, the tab-like contact portion 6 of the male terminal 5 electrically connects with the contact portion 15*c* of the resilient contact member 15.

The low force insertion enabling means, as shown in FIGS. 1 and 2, consists of a pair of cutouts 20 formed in the front half 16*a*, at laterally opposite sides thereof, of the resilient contact member 15 between the contact portion 15*c* and the front end 15*a* and in the rear half 16*b*, at laterally opposite sides thereof, between the contact portion 15*c* and the rear end 15*b*. Each cutout 20 may be of curved shape (FIG. 2) or rectangular shape (FIG. 3). Although the cutouts of curved shape and rectangular shape are provided in a directly opposed arrangement in the present embodiment, it is also possible to provide them in a slightly longitudinally shifted manner relative to each other. Further, cutouts 20 may be provided at either one of the front and rear halves 16*a*, 16*b*.

By thus forming cutouts 20 in the resilient contact member 15, the resilient force (rebound or repulsion) at the of a male connector housing (not shown), and contact ribs 18' projecting from the ceiling wall 13 into the interior of the electrical contact section 10.

The cable connection section 40 has pairs of upstanding holder pieces 41, 42, one of which 41 are crimped on the conductor 3*a* of the cable 3, and the other of which 42 are crimped on the cover 3*b* of the cable 3 to solderlessly attach the cable 3 to the female terminal 1.

The operation of the resilient contact member 15 at the time of inserting the male terminal 5 into the electrical contact section 10 will now be described.

As shown in FIGS. 1 and 2, the tab-like contact portion 6 of the male terminal 5 is inserted through the terminal insertion opening 19 into the electrical contact section 10. The tab-like contact portion 6 comes into contact with the front half 16*a* of the resilient contact member 15 inside the electrical contact section 10. As the tab-like contact portion 6 is further inserted, the resilient contact member 15 resiliently deflects at the front half 16*a* and is as a whole depressed toward the bottom wall 11.

At this time, because of the reduced resilient force of the contact member 15 due to the cutouts 20 formed at its front and rear halves 16*a*, 16*b*, the tab-like contact portion 6 and thus the male terminal 5 can be inserted into the electrical contact section 10 with a low insertion force. The tab-like contact portion 6, after sliding on the front half 16*a* of the contact member 15, comes into contact with the contact portion 15*c*. Because the contact portion 15*c* is of the same shape as in the described related art, it stably holds the tab-like contact portion 6 between it and the ceiling wall 13 and in electrical connection with the electrical contact section 10. The tab-like contact portion 6 is thus maintained in a stably electrically connected condition with the contact portion 15*c* of the contact member 15.

Figure 4:
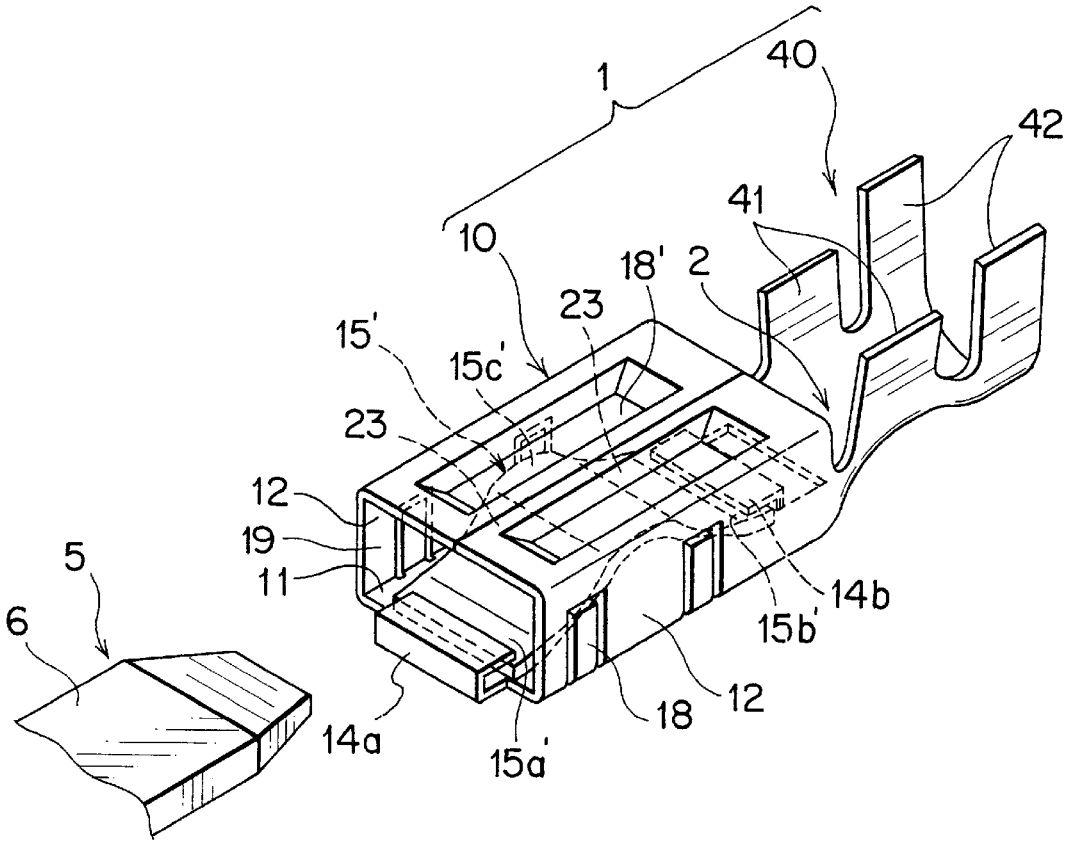
FIG. 4 is a perspective view of a female terminal according to a second embodiment of this invention, with the male terminal partly shown.
Figure 5:
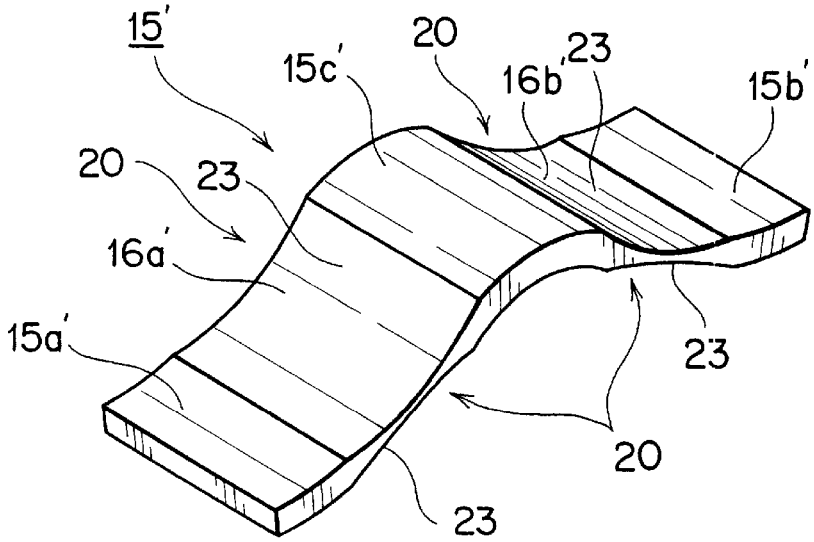
FIG. 5 is an enlarged perspective view of a resilient contact member as in FIG. 4.
Figure 6:
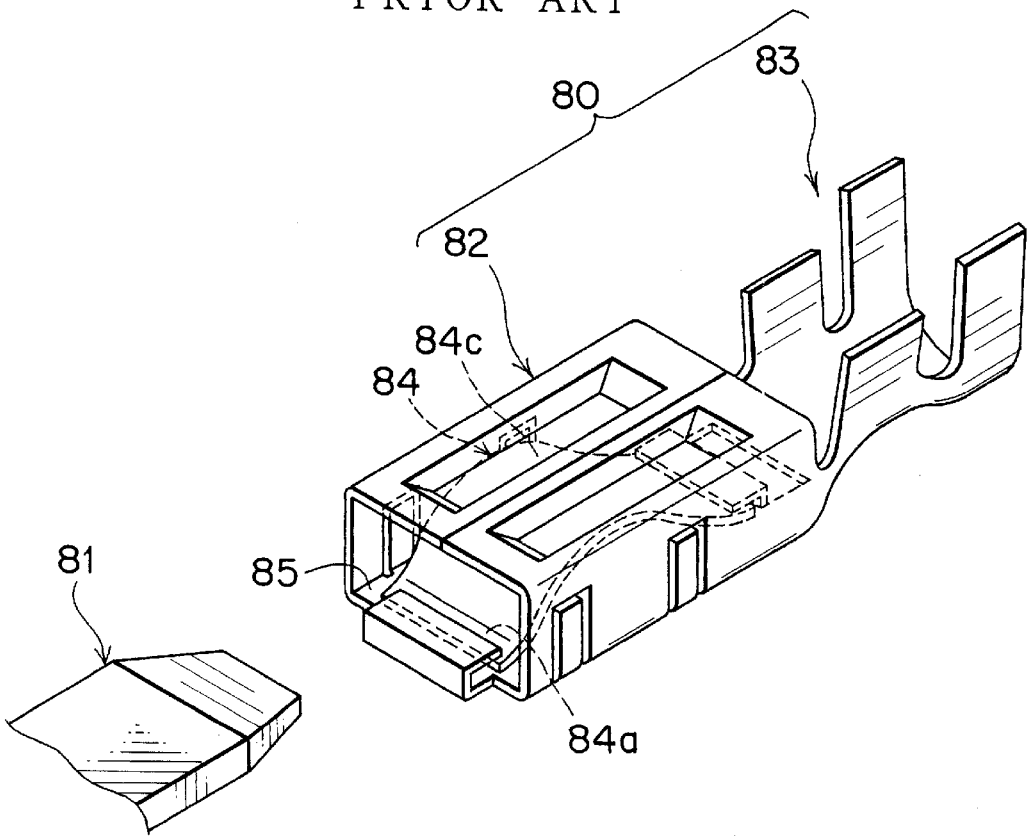
FIG. 6 PRIOR ART
FIG. 6 is a perspective view of a conventional female terminal.
Figure 7:
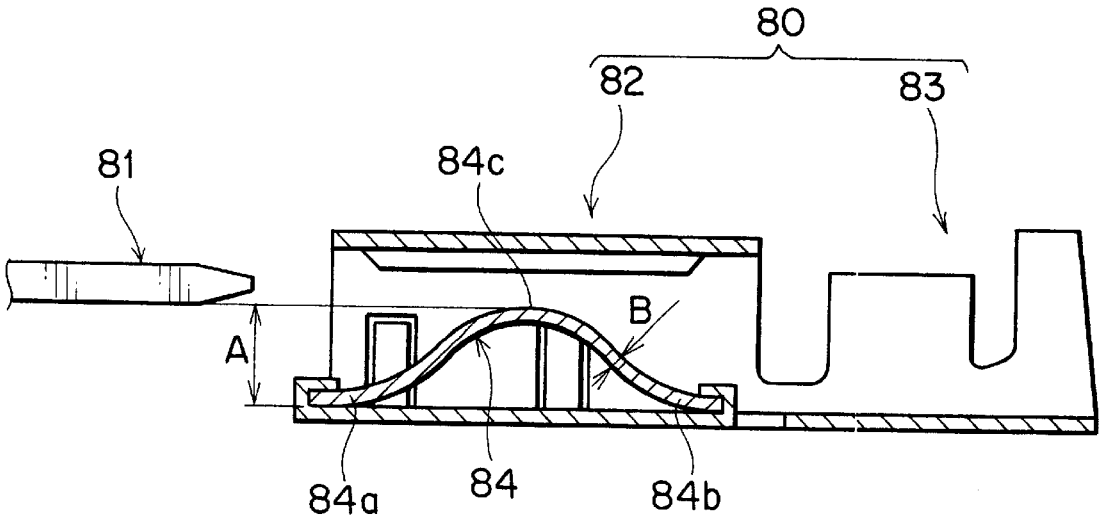
FIG. 7 PRIOR ART
FIG. 7 is a longitudinal sectional view of the female terminal of FIG. 6.
Figure 8:
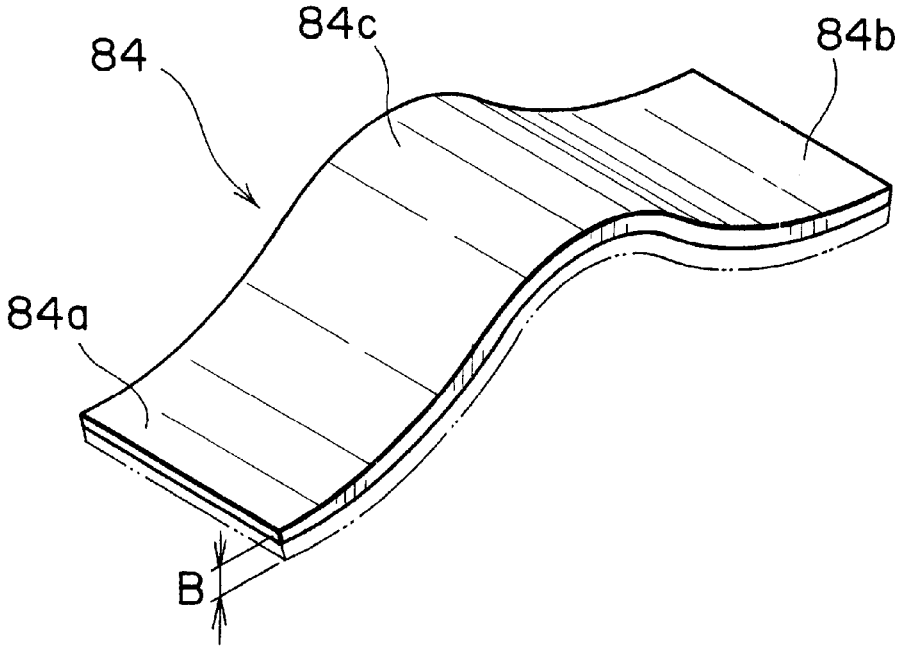
FIG. 8 is an enlarged perspective view of a resilient contact member as in FIG. 6, with its wall thickness reduced.
Figure 9:
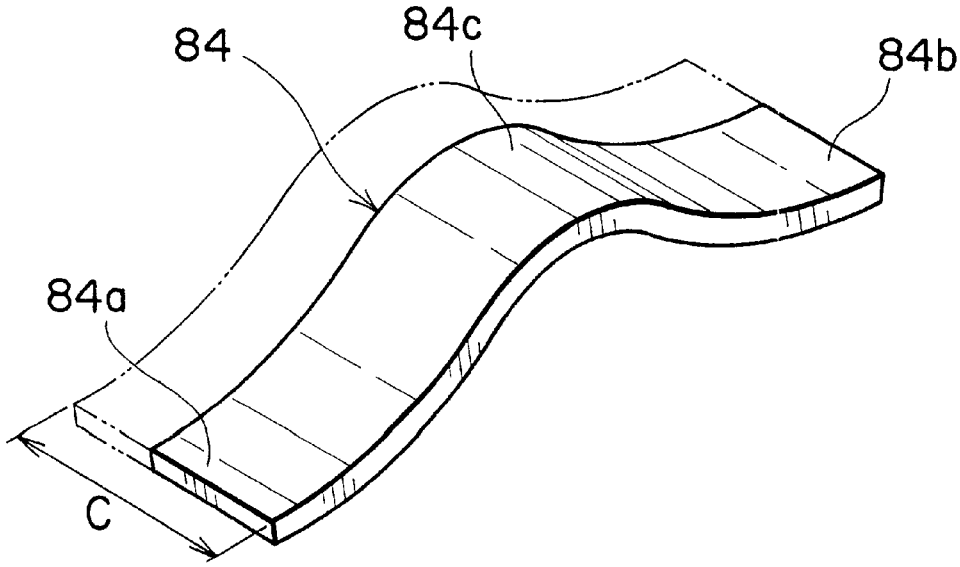
FIG. 9 is a view similar to FIG. 8, showing the resilient contact member with its wall width reduced.

FIGS. 4 and 5 show a female electrical terminal according to a second embodiment of this invention.

In FIGS. 4 and 5, the female terminal 1 has a resilient contact member 15' whose wall thickness is reduced at its front half 16*a'* and rear half 16*b'* to provide thin wall portions 23. It is also possible to provide the thin wall portion 23 at either one of the front and rear halves 16*a'* and 16*b'*. Further, the degrees to which the wall thickness is reduced may differ from one to the other of the front and rear halves 16*a'* and 16*b'*.

The thin wall portions 23 are formed at the front and rear halves 16*a'*, 16*b'*, leaving the front and rear ends 15*a'* and 15*b'* and the central contact portion 15*c'* of the resilient contact member 15' unreduced to have the same wall thickness as, for example, in the described related art. Owing to this, the force with which the male terminal 5 is inserted into the electrical contact section 10 can be reduced, and after insertion, the tab-like contact portion 6 of the male terminal 5 can be stably maintained in contact with the contact portion 15*c'* of the resilient contact member 15'. Further, because of the simple structure in which the wall thickness is reduced, a change in design can be easily made.

While in the above examples, the resilient contact member 15, 15' is shown to be arranged on the bottom wall 11, it is also possible to arrange same on the ceiling wall 13. Further, because the low force insertion enabling means as described are only one means for attaining a reduction in the insertion force of the male terminal 5 while fulfilling the condition of easy changeability in design, this invention is not limited to the examples as described above.

Thus, as described hereinabove, according to this invention, because there are provided low force insertion enabling means on the resilient contact member, a reduction can be made in the force with which the male terminal is inserted into the electrical contact section, while after insertion maintaining the male terminal in a stably connected condition with the electrical contact section.

Having now fully described the invention, it will be apparent to one of ordinary skill in the art that many changes and modifications can be made thereto without departing from the spirit and scope of the invention as set forth herein.

What is claimed is:

1. A female electrical terminal, comprising:

a box-like electrical contact section;

a resilient contact member contained in said electrical contact section for electrical connection with a male electrical terminal, said resilient contact member is at its front and rear ends held in position on an inner wall of said electrical contact section such that its longitudinally central contact portion is located elevated from said inner wall; and a low force insertion enabling means provided on said resilient contact member, which enables a reduction in an insertion force with which to insert said male electrical terminal into said electrical contact section and into electrical connection with said resilient contact member, said low force insertion enabling means comprises a pair of cutouts formed at laterally opposite sides of said resilient contact member between said central contact portion and at least one of said front and rear ends of said resilient contact member and said pair of cutouts are of rectangular shape.

2. A female electrical terminal, comprising:

a box-like electrical contact section;

a resilient contact member contained in said electrical contact section for electrical connection with a male electrical terminal, said resilient contact member is at its front and rear ends held in position on an inner wall of said electrical contact section such that its longitudinally central contact portion is located elevated from said inner wall; and a low force insertion enabling means provided on said resilient contact member, which enables a reduction in an insertion force with which to insert said male electrical terminal into said electrical contact section and into electrical connection with said resilient contact member, said low force insertion enabling means comprises a pair of cutouts formed at laterally opposite sides of said resilient contact member between said central contact portion and at least one of said front and rear ends of said resilient contact member and said pair of cutouts are of curved shape.

3. A female electrical terminal, comprising:

a box-like electrical contact section;

a resilient contact member contained in said electrical contact section for electrical connection with a male electrical terminal, said resilient contact member is at its front and rear ends held in position on an inner wall of said electrical contact section such that its longitudinally central contact portion is located elevated from said inner wall; and a low force insertion enabling means provided on said resilient contact member, which enables a reduction in an insertion force with which to insert said male electrical terminal into said electrical contact section and into electrical connection with said resilient contact member, said low force insertion enabling means comprises a thin wall portion at which said resilient contact member is reduced in thickness, said thin wall portion being located between said central contact portion and at least one of said front and rear ends of said resilient contact member.

* * * * *